US011190888B2

(12) United States Patent
Beedham et al.

(10) Patent No.: US 11,190,888 B2
(45) Date of Patent: Nov. 30, 2021

(54) CERUMEN FILTER APPLICATOR

(71) Applicant: SONOVA AG, Staefa (CH)

(72) Inventors: Martyn Beedham, Zurich (CH); Erich Dittli, Reichenburg (CH); Andre Ochsenbein, Wolfhausen (CH); George Meier, Uerikon (CH); Christoph Bosshard, Stafa (CH); Josef Müller, Feusisberg (CH); Marius Ruefenacht, Volketswil (CH); Erdal Karamuk, Mannedorf (CH); Markus Muller, Mannedorf (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/767,082

(22) PCT Filed: Nov. 28, 2017

(86) PCT No.: PCT/EP2017/080617
§ 371 (c)(1),
(2) Date: May 26, 2020

(87) PCT Pub. No.: WO2019/105522
PCT Pub. Date: Jun. 6, 2019

(65) Prior Publication Data

US 2020/0296528 A1 Sep. 17, 2020

(51) Int. Cl.
*H04R 25/00* (2006.01)

(52) U.S. Cl.
CPC ..... *H04R 25/654* (2013.01); *H04R 2460/17* (2013.01)

(58) Field of Classification Search
CPC ..... H04R 25/654; H04R 25/656; H04R 2225/023; H04R 25/60; H04R 2460/09
USPC ..... 381/312, 325, 328
See application file for complete search history.

(56) References Cited

U.S. PATENT DOCUMENTS

| | | | |
|---|---|---|---|
| 4,870,689 | A | 9/1989 | Weiss |
| 4,972,488 | A | 11/1990 | Weiss |
| 5,131,128 | A | 7/1992 | Bisgaard |
| 6,795,562 | B1 | 9/2004 | Gunnersen |

(Continued)

FOREIGN PATENT DOCUMENTS

| | | |
|---|---|---|
| EP | 0312517 | 4/1989 |
| EP | 1562400 | 5/2005 |
| WO | 03067926 | 8/2003 |

OTHER PUBLICATIONS

International Search Report and Written Opinion received in International Application No. PCT/EP2017/080617.

*Primary Examiner* — George C Monikang
(74) *Attorney, Agent, or Firm* — ALG Intellectual Property, LLC

(57) ABSTRACT

A tool for replacing a cerumen filter in a sound conduit of a hearing aid. The tool is designed to position a cerumen filter along the sound conduit and to couple with and remove a cerumen filter that has been positioned along the sound conduit. The tool comprises an insertion tip and an removal tip, both configured to fit inside the sound conduit and to couple or engage with an engagement body extending centrally from the cerumen filter. The tool may be in the form of a stylus with the insertion tip on one and the removing tip on the other end. The tool may also be in the form of a disc dispenser with a plurality of insertion and removal tips attached to the dispenser and accessible for use by rotating plates making up the disc dispenser.

20 Claims, 6 Drawing Sheets

(56) References Cited

U.S. PATENT DOCUMENTS

| | | | |
|---|---|---|---|
| 2009/0046880 | A1 | 2/2009 | Gunnersen |
| 2014/0193012 | A1 | 7/2014 | Lindebjerg |

CERUMEN FILTER APPLICATOR

Embodiments of the present disclosure relate to a tool for manipulating/replacing a replaceable cerumen filter, such as a cerumen protection plug, in a hearing device. More particularly, but not by way of limitation, the applicator tool is configured to remove the replaceable cerumen filter from a sound conduit of the hearing device and/or insert the replaceable cerumen filter into the sound conduit.

A hearing device may be used to improve the hearing capability or communication capability of a user, for instance by compensating a hearing loss of a hearing-impaired user, in which case the hearing device is commonly referred to as a hearing instrument, such as a hearing aid, or hearing prosthesis. A hearing device may also be used to produce a sound in a user's ear canal. For example, sound may be communicated by a wire or wirelessly to a hearing device, which may reproduce the sound in the user's ear canal. For example, earbuds, earphones, hearables and/or the like may be used to generate sound in a person's ear canal.

Hearing devices are generally small and complex devices. Hearing devices can include a processor, microphone, speaker, memory, housing, and other electronical and mechanical components. Some example hearing devices are Behind-The-Ear ("BTE"), Receiver-in-Canal ("RIC"), In-The-Ear ("ITE"), Completely-In-Canal ("CIC"), and Invisible-In-The-Canal ("IIC") devices. A user can prefer one of these hearing devices compared to another device based on hearing loss, aesthetic preferences, lifestyle needs, and budget. Hearing devices are often very small so that at least a part of the hearing device can be inserted into a user's ear canal to provide for reproduction of sound proximal to the user's eardrum.

As hearing device technology develops, users prefer hearing devices with more functionality. For example, users want hearing devices that are configured to communicate wirelessly. Wireless communication improves a user's experience and enables the user to access a network or other devices with their hearing device. Additionally, users want hearing devices that have a long battery life (e.g., several days or even weeks) and that need little/infrequent maintenance.

In many instances, the hearing device uses a microphone to pick up/receive sound. Circuitry in the hearing instrument can process signals from the microphone, and provide the processed sound signal into the ear canal of the user via a miniature loudspeaker, commonly referred to as a sound reproduction device or a receiver. As noted previously, some hearing devices may receive sound signals from alternative input sources, such as an induction coil and/or a wireless transmitter, for example via a mobile phone, wireless streaming, Bluetooth connection and/or the like, and process these sounds signals and deliver them to the user.

Hearing devices are designed so that at least a part of the hearing device housing is inserted within a hearing device user's ear canal. In such hearing devices, a receiver is disposed within a receiver housing and the acoustic output from the receiver is delivered into the user's ear canal via a sound conduit. The sound conduit may comprise a receiver port through which acoustic signals from the receiver pass into the sound conduit and a sound opening through which acoustic signals pass out of the sound conduit into the ear canal.

A problem for hearing devices that deliver sound into a user's ear canal is that cerumen (ear wax) may clog the sound conduit and reduce sound reproduction of the hearing device. At the extreme, the cerumen may clog the receiver port preventing sound production or may pass through the receiver port and damage internal components of the hearing device, such as the receiver and related electronic circuitry.

U.S. Pat. No. 4,870,689 (the "'689 patent") and U.S. Pat. No. 4,972,488 (the "'488 patent") describe replaceable cerumen filters/barriers that are screwed onto the acoustic conduit using a threaded connector. To replace such cerumen filters, a tool may be used comprising a plurality of tongs that can be inserted into two or more openings in the filter so that rotation of the tool rotates the filter screwing it onto or off the acoustic sound conduit.

U.S. Pat. No. 5,131,128 (the "'128 patent") describes a protection element for an all-in-the-ear hearing aid and a tool for replacing the protection element. In the '128 patent, the protection element is in the form of a cap that can be snapped down over the sound opening of a sound conduction tube. The cap comprises an internal circular flange that is configured to be snapped down over a projecting flange on the end of the sound conduction tube. In the '128 patent, the cap is removed by pushing the sound conduit into an opening and, essentially, scrapping the cap from the sound conduit, in a similar manner to removing a bottle cap from a bottle.

U.S. Pat. No. 6,795,562 (the "'562 patent") describes an ear wax guard for an acoustic outlet port of a hearing aid comprising an essentially tubular/cylindrical element containing a filter with an abutment collar at one end. The cerumen filter of the '562 patent is designed so that the tubular element is pushed into a sound opening formed at an end of a sound conduit of the hearing device until the abutment collar butts against the sound opening, thereby holding the filter in position in the sound opening.

In United States Patent Pub. No. 2009/0046880 (the "'880 publication") an insertion/removal tool for replacing the ear wax guard of the type described in the '562 patent is provided. The '880 publication describes a tool comprising a pin that can be inserted into the internal cavity of the ear wax guard to provide for pushing the ear wax guard into an end of an acoustic outlet port of a hearing device until the abutment collar butts against the sound opening. The '880 publication also describes the tool having a harpoon shaped end that can be inserted into the internal cavity of the ear wax guard, the cavity formed by the cylindrical/tubular element, to "harpoon" the ear wax guide so it can be removed from the acoustic outlet port.

SUMMARY

Embodiments of the present disclosure provide an applicator/manipulation tool for replacing a replaceable cerumen filter/protection plug in a sound conduit of a hearing device, where replacing the replaceable cerumen filter/protection plug comprises inserting/positioning the replaceable cerumen filter/protection plug inside the sound conduit and/or removing the replaceable cerumen filter/protection plug from the sound conduit.

In embodiments of the present disclosure, the applicator tool comprises two applicator tips, an insertion tip and a removal tip. The insertion tip is configured in use to fit at least partially inside a sound conduit of a hearing device and is configured to provide for inserting and positioning a cerumen along the sound conduit. The removal tip is configured in use to fit at least partially inside a sound conduit of a hearing device and is configured to provide for coupling with and removing the cerumen filter from the sound conduit.

Both the insertion and the removal tip comprise a cavity that is configured to accommodate at least a portion of the cerumen filter, for the insertion tip this is referred to as the insertion tip cavity and for the removal tip this is referred to as the removal tip cavity. In some embodiments, the cavity is centrally located on the applicator tip.

In some embodiments, the cerumen filter comprises a plug-type filter with an engagement body extending from a cerumen filter plug. The engagement body is designed to provide a kind of handle that can be engaged by the applicator tips to manipulate the cerumen filter plug in the sound conduit. In use, the engagement body is configured to extend along the sound conduit towards the sound opening so that it can be manipulated by the applicator tool via the sound opening. The cavity in the applicator tip is configured to accommodate/engage with the engagement body to provide for manipulating the cerumen protection plug in the sound conduit. In some embodiments, one or more of the applicator tips are sized to fit closely into the sound conduit, whereby the sound conduit serves as a guide to provide for engagement between the cavity and the engagement body.

In embodiments of the present disclosure, where the insertion tip is configured to insert/position the cerumen filter along the sound conduit, at least part of the insertion tip and/or a shoulder/ridge in the insertion tip cavity may be configured to butt against a section of the cerumen filter. In such embodiments, the insertion tip may be inserted into the sound conduit and may push the cerumen filter along the sound conduit. In some embodiments, the cerumen filter is position on the insertion filter, such that the engagement body is accommodated inside the insertion cavity, and the insertion tip is used to insert the cerumen filter into the sound conduit. For example, in some embodiments, a cerumen applicator may be provided to a user with a cerumen filter positioned on the insertion tip so that a user only has to insert the insertion tip with attached cerumen protection plug into the sound conduit to position the cerumen protection plug in the sound conduit. Since the sound conduit and the cerumen protection plug are small objects, of the order of millimetres in size, such an insertion method minimizes the coordination needed by the user to install the cerumen protection filter, i.e., the user only has to push the sound conduit over the engagement tip or the engagement tip into the sound conduit to insert the cerumen filter.

In some embodiments, the cerumen filter may be held on the insertion tip by frictional/contact forces, i.e., the part of the cerumen filter accommodated in the insertion tip cavity may have similar dimensions to the insertion tip cavity to provide for contact/frictional forces holding the cerumen filter in cavity. In some embodiments, the cerumen filter may be coupled with the insertion tip via a breakable coupling, such as a thin tag connecting the filter and applicator tip, that is configured to break when the applicator is removed from the sound conduit. In some embodiments, the cerumen filter may comprise a size/shape, such that it is held in a position along the sound conduit after insertion to provide that the cerumen filter is held in the position in the sound conduit as the applicator is removed from the sound conduit.

In embodiments of the present disclosure, where the removal tip is configured to couple with the cerumen filter is configured to provide for removing the cerumen filter from the sound conduit, the walls of the removal tip cavity may have elastic properties and/or the walls may be elastically coupled with a body of the applicator, such that the walls of the removal tip cavity can expand to accommodate the engagement body and clamp onto the engagement body. In such embodiments, the removal tip may be inserted into and along the sound conduit so that the walls of the removal tip cavity elastically adapt to accommodate engagement body and elastically clamp onto the engagement body, thereby coupling the applicator with the cerumen filter.

In some embodiments, the engagement body may comprise a tapered end section starting from a broad shoulder section proximal to the body of the cerumen filter/cerumen filter plug and a narrow tapered end configured in use to be proximal to the sound opening of the sound conduit, such that the removal tip can be slid into the sound conduit through the sound opening and the removal tip cavity can slide over and elastically adjust to accommodate the tapered section of the engagement body and then clamp behind the shoulder of the tapered section.

In some embodiments, the applicator may comprise a stylus or the like having two ends comprising the insertion tip at one end of the stylus and the removal tip at the other end of the stylus. In such embodiments, a single manipulation tool provides a mechanism for insertion/removal of the cerumen filter.

In other embodiments, the applicator may be designed to provide ease of handling and/or to provide that the user can identify whether the cerumen filter is new or used. In such embodiments, the manipulation tool may comprise a circular base plate rotatably coupled with a circular top plate. The plates may be made of plastic or the like and the top plate may comprise a first and a second-round opening disposed at different distances along a diameter of the top plate.

In use, by rotating the top plate, the first-round opening can be rotated to provide access through the top plate to a one of the removal tips, which is coupled with the base plate. To remove the cerumen filter from the sound conduit, the user may push the sound conduit through the first-round opening and onto the removal tip. The first-round opening may be configured to guide the sound conduit onto the removal tip. For example, the first-round opening may have a funnel like shape configured to guide the sound conduit onto the removal tip.

The length of the removal tip may be configured to provide that the user pushes the sound conduit into the first-round opening until the sound opening at the end of the sound conduit contacts the base plate. The cerumen filter and the removal tip may be configured such that the user hears/feels a "click" when the removal tip couples with the cerumen filter.

The rotating top plate may be rotated so that the second-round opening may provide access through the top plate to a one of the insertion tips, which is coupled with the base plate. In some embodiments, the first and the second-round openings may be aligned such that rotation of the top plate provides access to both the removal and insertion tips. In some embodiments, the applicator may be configured to provide that a user can only access an insertion tip that includes a new cerumen filter, i.e., one that has not been used previously.

In some embodiments, the insertion tip is provided in the applicator coupled with a one of the cerumen filters. This coupling may comprise a friction/contact type coupling, where the cerumen filter is sized such that it is held be frictional/contact forces in the insertion tip cavity. In other embodiments, an easily breakable coupling may be used to couple the cerumen filter to the insertion tip.

In use, the user may push the sound conduit of the hearing device into the second-round opening, such that the sound conduit passes over at least a part of the insertion tip. In some embodiments, the cerumen filter is shaped sized so that contact/friction forced hold the cerumen filter in the sound conduit when the insertion tip is removed from the second-round opening. Retention of the cerumen filter in the sound conduit may be provided by the sizing/shape of the cerumen filter. For example, a diameter of the cerumen filter may be equal to or slightly greater than a diameter of the sound conduit to provide that frictional/contact forces retain the cerumen filter in the sound conduit. In some aspects, the cerumen filter may have ridges on its circumference that extend the diameter of the cerumen filter beyond that of the internal diameter of the sound conduit. In some embodiments, the cerumen filter may comprise a circumferential ridge that is configured to latch into a corresponding indent in the inner-surface of the sound conduit once the cerumen filter is inserted into the sound conduit.

In embodiments of the present disclosure, the insertion tip and/or the sound conduit may comprise a stop that stops movement of the sound conduit relative to the insertion tip when the cerumen filter is located at an insertion position in the sound conduit. In some embodiments, the applicator may have a length extending from the base plate such that the base plate acts as the stop for correct positioning of the cerumen filter in the sound conduit.

In some embodiments, the second-round opening may act as a guide so that the cerumen filter passes along the sound conduit when the sound conduit is pushed into the second-round opening. Hearing device sound conduits and cerumen filters are, in general, very small, difficult to manipulate objects. In embodiments of the present disclosure, because the cerumen filter is configured to be installed along the sound conduit, an applicator comprising a round opening with an insertion tip disposed below can be configured, such that the insertion tip coupled with a new cerumen filter is aligned with a longitudinal axis of the sound conduit when the sound conduit is pushed axially though the round opening. In such embodiments, the user may handle the hearing device and the applicator insert a new cerumen filter, removing any need to manipulate either the sound conduit itself or the cerumen filter. Moreover, the user does not have to perform any subtle alignment of the insertion tip and sound conduit. In some embodiments, the first and/or the second-round openings may have a funnel type shape to guide the sound conduit with respect to the insertion tip and/or the removal tip.

BRIEF DESCRIPTION OF THE DRAWINGS

In the figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

Figure 1:
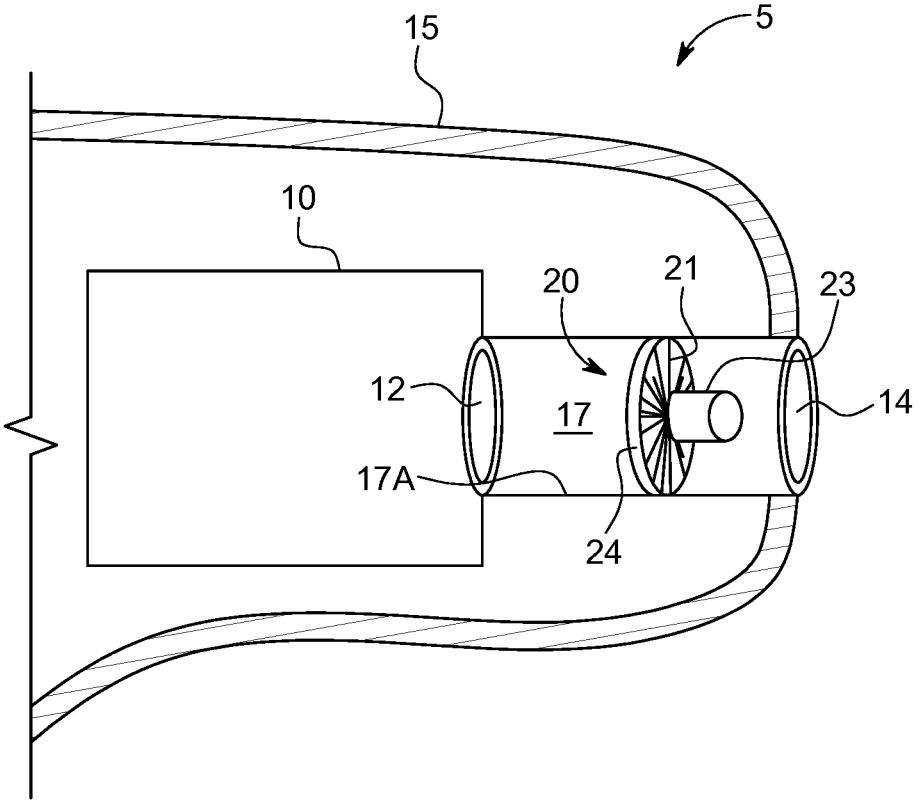
FIG. 1 illustrates part of a hearing device configured to be worn at least partially in a user's ear fitted with a cerumen filter/cerumen protection plug configured for insertion/removal using an applicator, in accordance with some embodiments of the present disclosure.

These and further objects, features and advantages of the present invention will become apparent from the following description when taken in connection with the accompanying drawings, which, for purposes of illustration only show several embodiments in accordance with the present application.

DESCRIPTION

The ensuing description provides some embodiment(s) of the invention, and is not intended to limit the scope, applicability or configuration of the invention or inventions. Various changes may be made in the function and arrangement of elements without departing from the scope of the invention as set forth herein. Some embodiments may be practiced without all the specific details. For example, circuits may be shown in block diagrams in order not to obscure the embodiments in unnecessary detail. In other instances, well-known circuits, processes, algorithms, structures and techniques may be shown without unnecessary detail in order to avoid obscuring the embodiments.

Some embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure and may start or end at any step or block. A process may correspond to a method, a function, a procedure, a subroutine, a subprogram, etc. When a process corresponds to a function, its termination corresponds to a return of the function to the calling function or the main function.

The phrases "in some implementations," "according to some implementations," "in the implementations shown," "in other implementations," and generally mean the particular feature, structure, or characteristic following the phrase is included in at least one implementation of the disclosed technology, and may be included in more than one implementation. In addition, such phrases do not necessarily refer to the same embodiments or different implementations.

Reference will now be made in detail to embodiments, examples of which are illustrated in the accompanying drawings and figures. In the following detailed description, numerous specific details are set forth in order to provide a thorough understanding of the subject matter herein. However, it will be apparent to one of ordinary skill in the art that the subject matter may be practiced without these specific details. In other instances, well known methods, procedures, components, and systems have not been described in detail so as not to unnecessarily obscure features of the embodiments. In the following description, it should be understood that features of one embodiment may be used in combination with features from another embodiment where the features of the different embodiment are not incompatible.

FIG. 1 illustrates a part of a hearing device fitted with a cerumen filter that may be manipulated using an applicator, in accordance with some embodiments of the present disclosure.

As illustrated in FIG. 1, a hearing device 5 comprises a housing 15, which houses at least some of the electronic circuitry of the hearing device 5. A receiver 10 is disposed within the housing 15 and is configured to generate an acoustic output in a user's ear canal. In some embodiments, the receiver 10 may comprise a housing and this housing may house receiver electronics and other electronics of the hearing device 5, such as signal processing electronics, transmission electronics and/or the like.

In some hearing devices, sounds are received by a microphone (not shown) and converted into an electrical signal, which signal is processed (which processing may involve amplification), and transmitted to the receiver 10, which in turn generates the acoustic output.

The receiver 10 comprises a receiver output port 12 and the acoustic output from the receiver 10 is transmitted from the receiver output port 12 through a sound conduit 17 to a sound opening 14 formed in the housing 15. The sound conduit 17 may extend from the housing 15 forming a spout or the like with the sound opening 14 formed at an end of the spout.

In FIG. 1, a cerumen protection plug 20, which may comprise a cerumen filter or the like, is disposed in the sound conduit 17 between the receiver output port 12 and the sound opening 14. The cerumen protection plug 20 is configured to provide a barrier to cerumen travelling through the sound conduit 17 and blocking the receiver output port 12 and/or entering the receiver 10.

Previously, for example, as described in the '128 patent and the '880 publication, cerumen filters have generally been positioned over and/or in the sound opening 14. Installing/replacing such filters, has comprised using a pin/harpoon, such as described in the '880 publication, and/or a "scrapper" that can scrape a cerumen filter from the end of the sound conduit 17. Harpoon and scrapper type tools may damage the sound conduit and/or may fail to remove the cerumen filter, for example a harpoon type tool may deform the cerumen filter, which may damage/stress the sound opening around the harpooned cerumen filter, or may not provide for effective coupling with the tool leaving a deformed cerumen filter in the sound opening.

As depicted in FIG. 1, the cerumen protection plug 20 comprises an engagement body 23 that is configured to provide for engagement with a manipulation tool (not shown), in accordance with some embodiments of the present disclosure. The engagement body 23 provides in effect a handle that can be used to insert the cerumen protection plug 20 into and/or remove the cerumen protection plug 20 from the sound conduit 17.

The cerumen protection plug 20 comprises ring structure 24, the engagement body 23 and one or more spokes 21 connecting the ring structure 24 and the engagement body 23. The ring structure 23 and the one or more spokes 21 comprise a plug like structure that forms the cerumen barrier. The engagement body 23 forms a mechanism that can be engaged by an applicator tool to manipulate the cerumen protection plug 20.

The ring structure 24 may be configured to have an outside diameter that is either the same as or slightly larger than an internal diameter of the sound conduit 17. At least one of the ring structure 24 or the one or more spokes 21 may be made of a compliant material. The combination of the dimensions of the ring structure 24 with respect to the sound conduit 17 and the compliance of the ring structure 24 and/or the one or more spokes 21 provides that the cerumen protection plug 20 can be inserted along the sound conduit 17 and once inserted, frictional/contact forces between the outer-surface of the ring structure 24 and an inner-surface 17A of the sound conduit 17 may act to hold the cerumen protection plug 20 in position.

Unlike most of the previous cerumen barriers/wax guards/cerumen, filters, which provide a barrier at or proximal to the sound opening 14, the cerumen protection plug 20 is configured to be disposed along the sound conduit 17, between the receiver output port 12 and the sound opening 14. In this way, the cerumen protection plug 20 may be positioned, such that a portion of the inner-wall 17A of the sound conduit 17 extends between the ring structure 24 and the sound opening 14.

Where the cerumen protection plug 20 is disposed along the sound conduit 17, cerumen entering the sound conduit 17 must flow along the inner-wall 17A before encountering the cerumen protection plug 20. This provides for collection of a volume of the cerumen on the inner-wall 17A and may delay blocking of the sound opening 14, as may occur with conventional wax guards that are inserted into the sound opening 14. The positioning of the cerumen protection plug 20 along the sound conduit 17 away from the sound opening 14 may increases the length of time before the cerumen protection plug 20 needs to be replaced, reducing maintenance of the hearing device.

Figure 2A:
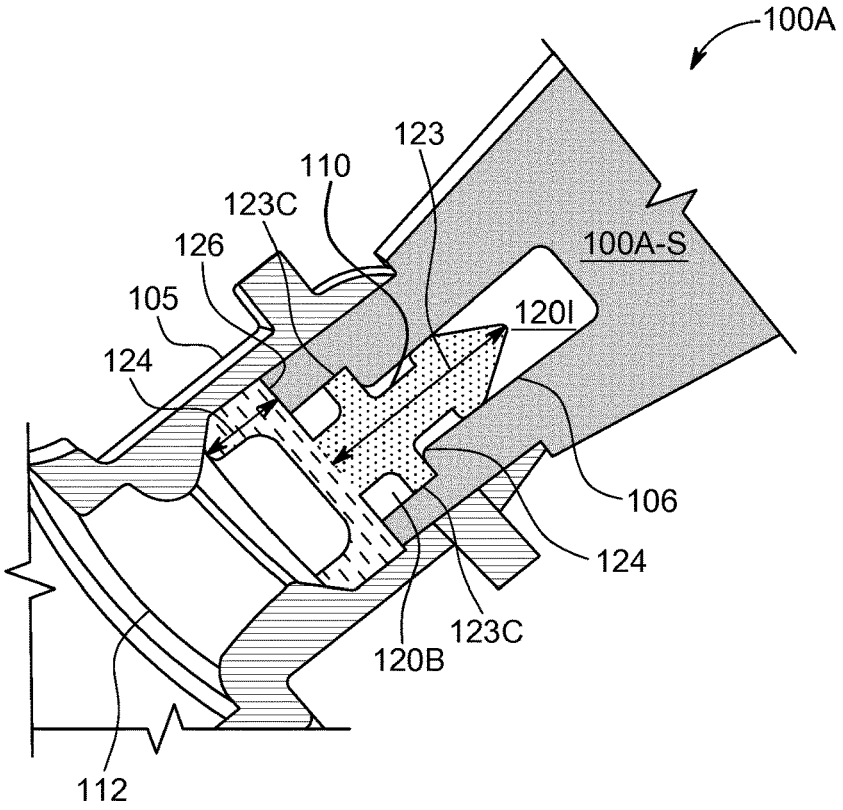
FIG. 2A illustrates an insertion tip of an applicator tool configured to insert and position a cerumen filter in a sound conduit of a hearing device, in accordance with some embodiments of the present disclosure.

FIG. 2A illustrates an insertion tip of an applicator tool for a replaceable cerumen filter/cerumen protection plug, in accordance with some embodiments of the present disclosure.

In FIG. 2A, an insertion tip 100A of an application tool is illustrated that is engaged with a cerumen protection plug 110. For purposes of this disclosure, the insertion tip 100A may be referred to as an engagement tip as the tip is configured to engage with the replaceable cerumen filter/cerumen protection plug. In embodiments of the present disclosure, the insertion tip 100A may be coupled with and or integrated with an applicator body (not shown). The insertion tip 100A is configured on a stem 100A-S, which may be an end of an applicator tool and/or a part of an applicator tool body, which may comprise a substrate or the like.

The insertion tip 100A comprises an insertion tip cavity 120I configured to accommodate/engage with a part of the cerumen protection plug 110. The applicator is configured to provide for inserting/positioning the cerumen protection plug 110 in a sound conduit 105 of a hearing device.

The cerumen protection plug 110 comprises an engagement body 123. The engagement body 123 comprises a protrusion/body or the like that is configured in use to extend from a ring structure 124 along the sound conduit 105. The ring structure 124 may comprise a ring, cylinder and/or the like with a filter/filter member (not shown) disposed within the ring structure 124 and configured to prevent cerumen flowing though the ring structure 124. The engagement body 123 may be coupled with/integrated with a hub (not shown) at the centre of the ring structure 124.

In some embodiments, an end 126 of the engagement tip 100A may be configured to butt against a part of the cerumen protection plug 126 when the engagement body 123 is disposed within the insertion tip cavity 120I. In this way, the engagement tip 100 can be used to push the cerumen protection plug 110 into and/or along the sound conduit 105.

In some embodiments, the insertion tip cavity 120I is shaped such that the insertion tip cavity 120I comprises a tip opening 120B that is wider than an internal cavity opening 120A. An engagement shoulder 124 may provide for the reduction in cross-sectional area of the insertion tip cavity 120I between the tip opening 120B and the internal cavity opening 120A. In some embodiments, the engagement shoulder 124 may be configured to butt against part of the part of the cerumen protection plug 110 when the engagement body 123 is disposed within the insertion tip cavity 120I. In this way, the manipulation tool may be used to manipulate the cerumen protection plug 110 in the sound conduit 105.

In some embodiments, the insertion tip cavity 120I is shaped to provide for enclosing/accommodating the engagement body 123. In such embodiments, the insertion tip cavity 120I may be sized/shaped to provide a snug fit with the engagement body 123, such that contact/frictional forces between the insertion tip cavity 120I and the engagement body 123 may serve to hold the cerumen protection plug 110 in the insertion tip cavity 120I. In this way, the manipulation tool may be provided to a user with the cerumen protection plug 110 coupled with the applicator so that the user can insert the cerumen protection plug 110 into the sound conduit 105 by inserting the engagement tip 100A of the applicator into the sound conduit 105.

As noted previously, in some embodiments, the insertion tip cavity 120I may be sized/shaped to contact the engagement body 123 to couple the cerumen protection plug 110 with the insertion tip 100A. For example, the cerumen protection plug 110 may comprise a holding fixture 123C configured to contact with an inner-surface of the insertion tip cavity 120I and couple the insertion tip 100A with the cerumen protection plug 110. The cerumen protection plug 110 may comprise a compliance providing for inserting at least a part of the cerumen protect plug 110 into the insertion tip cavity 120I.

Once inserted along the sound conduit 105, the cerumen protection plug 110 may be held in place by contact/frictional forces between the cerumen protection plug 110 and an inner-surface of the sound conduit 105. For example, the ring structure 124 may be sized to fit snugly in the sound conduit 110 or may be formed of a compressible material and may be oversized with respect to an internal diameter of the sound conduit 105. For example, an outer-surface of the ring structure 124 may comprise circumferential ridges that extend the outer-diameter of the ring structure 124 beyond that of the internal diameter of the sound conduit 105, providing for anchoring the cerumen protection plug 110 in the sound conduit 105.

In embodiments of the present disclosure, the engagement between the insertion tip 100A, the engagement body 123 and the ring structure 124 is configured to provide for inserting the ring structure 124 along the sound conduit 105, such that the ring structure 124 is not disposed in the sound opening 106 at the tip of the sound conduit 105. Disposing the ring structure 124 in such a manner provides that cerumen has to travel along the sound conduit 105 before it reaches the ring structure 124. This provides the cerumen protection plug 110 with a high cerumen capacity, i.e., the amount of cerumen that the cerumen protection plug 110 can handle before it gets blocked by cerumen and needs replacing. As depicted in FIG. 2A, the manipulation tool may be configured to dispose the cerumen protection plug 110 such that it is closer to a receiver output port 112 than the sound opening 106.

In some embodiments, the insertion tip 100A may have an outer diameter that is only slightly less than an internal diameter of the sound conduit 105. For example, the outer diameter of the insertion tip 100A may be of the order of tenths of millimetres less than the internal diameter of the sound conduit 105. This small difference in the two diameters allows for the sound conduit 105 to serving as a guide for the insertion tip 100A to provide for guiding the cerumen protection plug 110 centrally along the sound conduit 105.

Figure 2B:
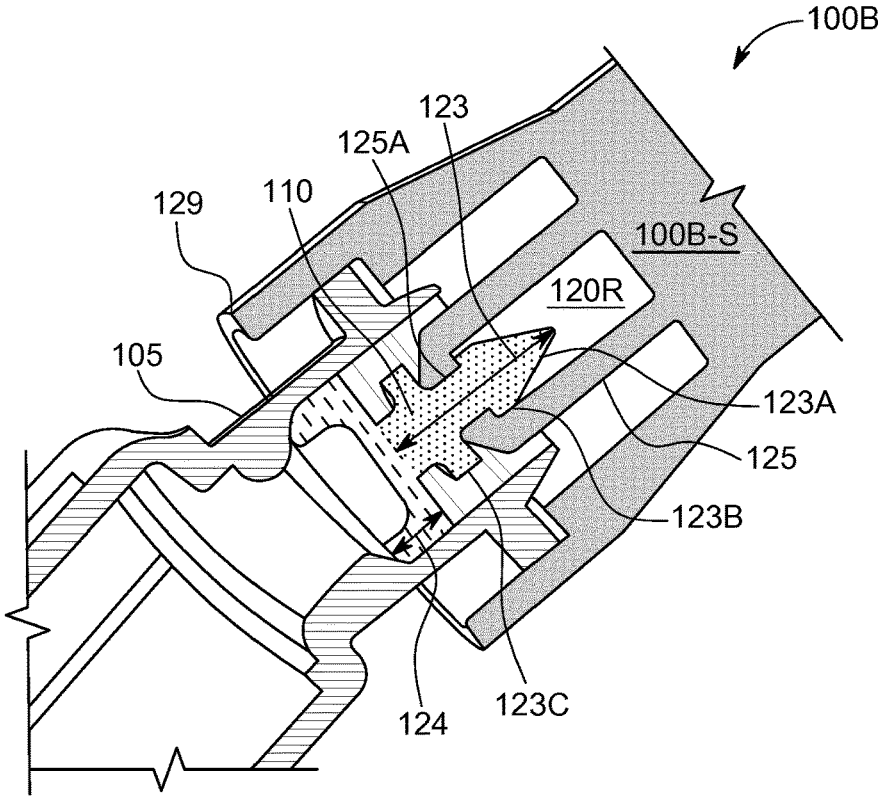
FIG. 2B illustrates a removal tip of an applicator tool configured to remove a cerumen filter from a sound conduit of a hearing device, in accordance with some embodiments of the present disclosure.

FIG. 2B illustrates a removal tip of an applicator for a replaceable cerumen protection plug/cerumen filter for a hearing device, in accordance with some embodiments of the present disclosure.

As depicted in 2B, a removal tip 100B of a replaceable cerumen filter applicator is configured to couple with the cerumen protection plug 110 to provide for removal of the cerumen protection plug 110 from the sound conduit 105 of a hearing device. For purposes of this disclosure, the removal tip 100B may be referred to as an engagement tip as the tip is configured to engage with the replaceable cerumen filter/cerumen protection plug.

In FIG. 2B, the removal tip 100B comprises a removal tip cavity 120R configured for engaging with the engagement body 123 of the cerumen protection plug 110. The removal tip cavity 120R is formed from a cavity wall 125. In some embodiments, the cavity wall 125 is formed from an elastic material and/or is elastically coupled with a stem 100B-S. The elasticity of the cavity wall 125 provides that the removal tip cavity 120R formed by the cavity wall 125 is adaptable and can clamp onto the engagement body 123. More particularly, the elasticity provides that an opening of the removal tip cavity 120R formed by the cavity wall 125 can adapt in size to receive the engagement body 123. In embodiments of the present disclosure, an outer-diameter of the cavity wall 125 is less than an inner-diameter of the sound conduit 105. In this way, the cavity wall 125 may flex/adapt without contacting/damaging the sound conduit 105.

In some embodiments, the cavity wall 125 may comprise a polymer, plastic, thermoplastic and/or the like. In such embodiments, the cavity wall 125 may have a thickness in the range of tenths of millimetres to less than about 5 millimetres. Such thin walls made of a plastic material, may provide for the flexing/adapting of the cavity wall 125, and in particular the cavity opening formed by the cavity wall 125, which provides for accommodate/engage with the engagement body 123. In some embodiments, the cavity wall 125 may have elastic properties or be rigid and the engagement body 123 may comprise a compliant material, such as a thermoplastic or the like to provide, at least in part for accommodating/engaging the engagement body 123 with the removal tip cavity 120R In some embodiments, the cavity wall 125 may comprises a plurality of separate members that are spaced apart from one another and define the removal tip cavity 120R. In such embodiments, the plurality of separate members may each flex to accommodate the engagement body 123.

The engagement body 123 may comprise a tapered end 123A. As such, the removal tip 100B may be manipulated with respect to the cerumen protection plug 110 so that the cavity wall 125 elastically adapts to the tapered end 123A and the tapered end 123A is accommodated/clamped inside the removal tip cavity 120R. For example, the removal tip 100B may be pushed along the sound conduit 105 so that the cavity wall 125, and more particularly a cavity opening formed by the cavity wall 125, is pushed over and along the tapered end 123A.

In some embodiments, the cavity wall 125 may include a grab 125A extending into the removal tip cavity 120R from the cavity wall 125 and configured to grab/clamp onto the tapered end 123A. For example, the tapered end 123A may include shoulders 123B and/or an indent (not shown) at the end of the tapering of the tapered end 123A, and the grab 125A may be configured as a protrusion from the cavity wall 125 and/or a lip around the cavity opening configured to clamp onto the engagement body 123 behind these shoulders 123A and/or with the indent in the engagement body 123. The cerumen protection plug 110 may also comprise a stop 123C configured to stop the cavity wall 125 at a grabbing/engagement position with respect to the cerumen protection plug 110. In some embodiments, the removal tip 100B is configured to click connect with the cerumen protection plug 110 such that an audible sound or a tactile feeling is provided when the removal tip 100B has accommodated/grabbed/coupled with the cerumen protection plug 110.

The cavity wall 125 is sized such that is can fit along the sound conduit 105 and flex in the sound conduit 105 so that it can adjust to accommodate the engagement body 123. In some embodiments, the removal tip 100B may comprise a collar 129 configured in use to slide over an outside of the sound conduit 105. The collar 129 may be used to provide a guide whereby the collar 129 is sized to slide closely over the outside of the sound conduit 105 and the removal tip cavity 120R is positioned centrally on the removal tip 100B so that it engages the engagement body 123 when the collar 129 guides the removal tip 100B into engagement with the sound conduit 105.

Figure 2C:
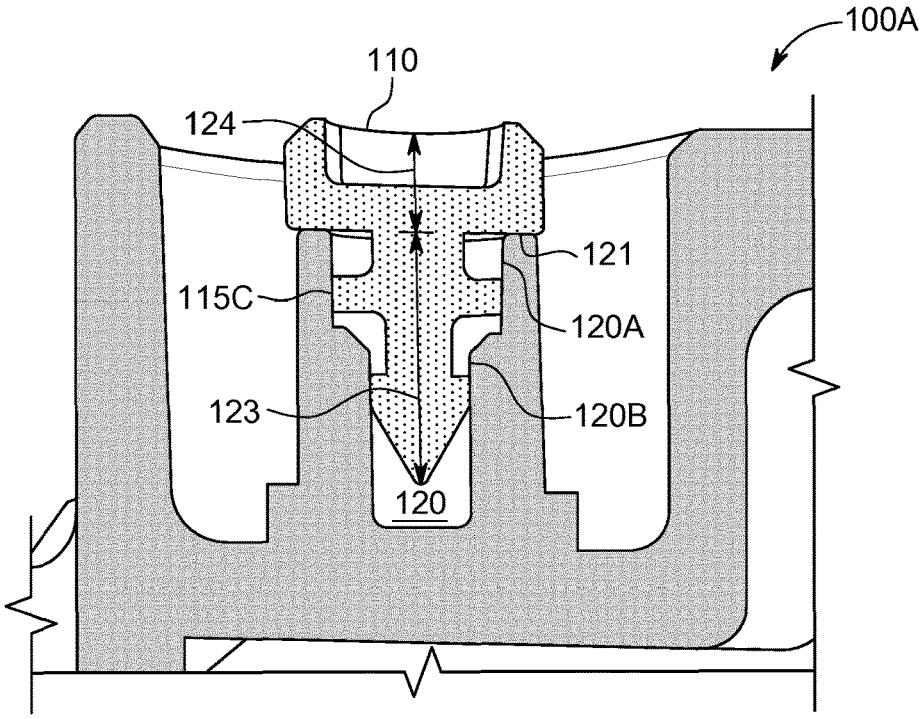
FIG. 2C illustrates an insertion tip, in accordance with embodiments of the present disclosure, coupled with a cerumen filter and configured for inserting the cerumen filter into a sound conduit of a hearing device.

FIG. 2C illustrates an insertion tip, in accordance with embodiments of the present disclosure, coupled with a cerumen protection plug and configured for inserting the cerumen protection plug into a sound conduit of a hearing device.

In some embodiments, an insertion tip 100A is provided coupled with a cerumen protection plug 110 ready for insertion into a hearing device's sound conduit (not shown). The cerumen protection plug 110 is provided with a part of the cerumen filter plug, an engagement body 123, disposed within an insertion tip cavity 120. The insertion tip cavity 120 is shaped/sized to provide that a cavity tip opening 120A contacts a holding fixture 115C on the engagement body 123. In this way, contact/frictional forces couple the insertion tip 100A with the cerumen protection plug 110.

In some embodiments, an internal cavity opening 120B has an internal diameter that is larger than an external diameter of a part of the engagement body 123 that it is configured to house; this is provided so that contact/frictional coupling can be overcome when the cerumen protection plug 110 is inserted in the sound conduit. In some embodiments, the insertion tip 100A is configured such that a ring structure 124 at the end of the cerumen protection plug 110, which houses the cerumen filter/barrier, sits on an end 121 of the insertion tip 100A. The configuration of the insertion tip 100A for holding the cerumen protection plug 110 not only provides for providing a user with a cerumen filter plug ready for insertion into the sound conduit, it also provides for inserting the cerumen filter, housed in the ring structure 124, along the sound conduit, rather than in the sound conduit opening.

Figure 2D:
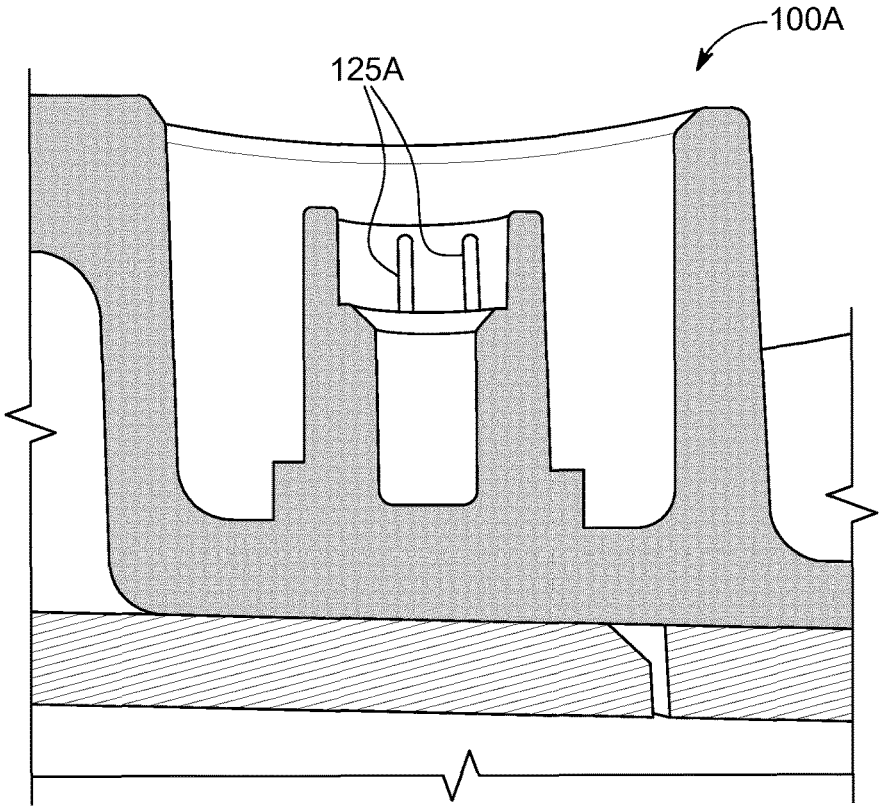
FIG. 2D illustrates an insertion tip for inserting a cerumen filter into a sound conduit of a hearing device, according to some embodiments of the present disclosure

FIG. 2D illustrates an insertion tip for inserting a cerumen filter plug into a sound conduit of a hearing device, according to some embodiments of the present disclosure.

In some embodiments, an insertion tip 100A comprises a plurality of ridges 125A formed around an inner-surface of an engagement cavity. The plurality of ridges 125A are configured to provide for generating a contact force with an engagement body of a cerumen protection plug disposed within the engagement cavity. This contact force couples the insertion tip 100A with the cerumen protection plug so that the insertion tip 100A can be provided with a cerumen protection plug ready for use. In some embodiments, an outer-surface of the engagement body of the cerumen protection plug (not shown) may have corresponding indents to provide for sliding the engagement body into the engagement cavity and coupling it therein using contact forces.

Figure 3A:
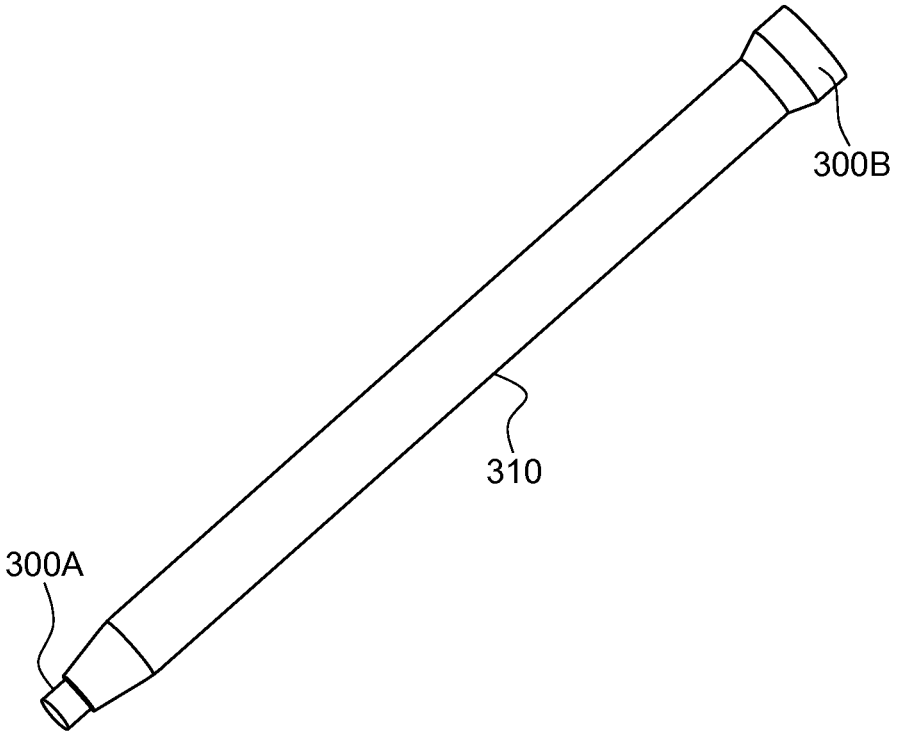
FIG. 3A illustrates a stylus-type applicator tool for use with a replaceable cerumen filter, in accordance with some embodiments of the present disclosure.

FIG. 3A illustrates a stylus-type applicator for use with a replaceable cerumen filter, in accordance with some embodiments of the present disclosure.

In some embodiments of the present disclosure, an applicator for manipulating a replaceable cerumen filter in a hearing device may comprise a stylus 310. The stylus 310 may comprise two ends with an insertion tip 300A at a first end and a removal tip 300B at a second end. The stylus 310 provides a user with a single tool comprising both the insertion tip 300A and the removal tip 300B. Moreover, the stylus 310 provides the user with a stylus body that can be used to manipulate the insertion tip 300A and/or the removal tip 300B.

Figure 3B:
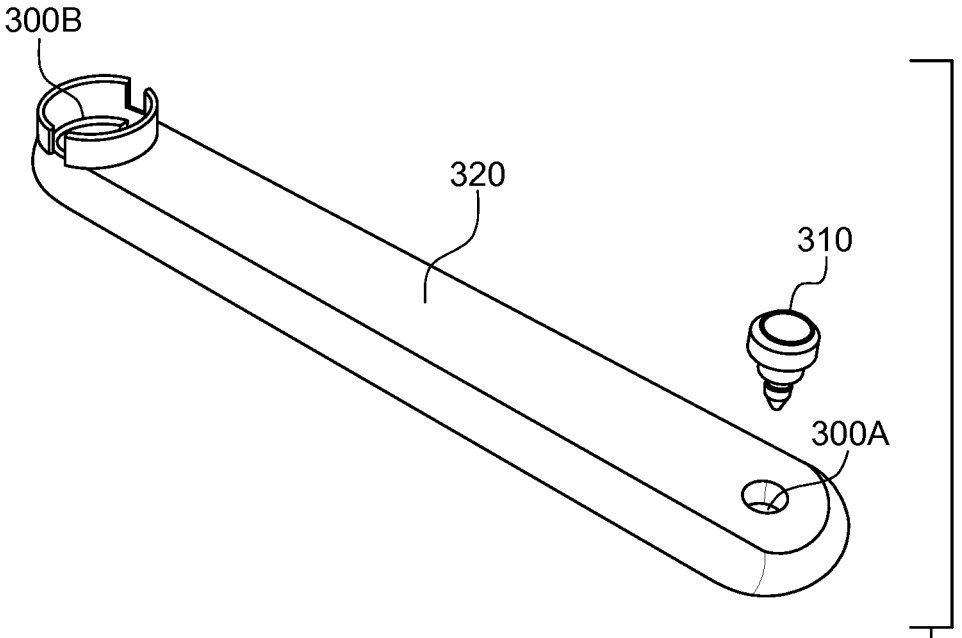
FIG. 3B illustrates a flat applicator tool for use with a replaceable cerumen filter, in accordance with some embodiments of the present disclosure.

FIG. 3B illustrates a flat applicator for use with a replaceable cerumen filter for a hearing device, in accordance with some embodiments of the present disclosure.

In some embodiments of the present disclosure, a flat applicator 320 may comprise a flat side (not shown) and an insertion tip 300A at a first end and a removal tip 300B at a second end. In FIG. 3B, a cerumen protection plug 310 is shown positioned above the insertion tip 300A. To insert the cerumen protection plug 310 into a sound conduit of a hearing device, the user positions at least part of the cerumen protection plug 310 in a cavity provided in the insertion tip 300A.

In some embodiments of the present disclosure, the flat side may provide for laying the flat applicator 320 on a surface. In this way, a user may hold the flat applicator 320 in contact with the surface and manipulate the hearing device (not shown) with respect to the flat applicator 320 to insert and/or remove the cerumen protection plug 310. Such embodiments may reduce the dexterity required of the user.

FIGS. 4A-D illustrate a replaceable cerumen filter applicator, in accordance with some embodiments of the present disclosure.

Figure 4A:
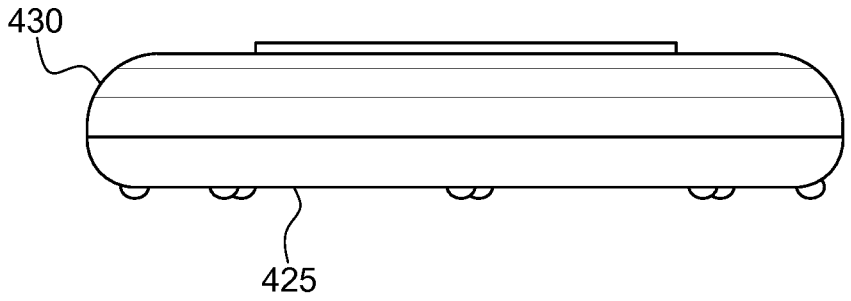
FIGS. 4A-D illustrate a disc shaped applicator tool, in accordance with some embodiments of the present disclosure.

FIG. 4A illustrates a side view of a cerumen filter applicator for inserting a cerumen filter into and/or removing a cerumen filter from a sound conduit of a hearing device, in accordance with some embodiments of the present invention.

As depicted in FIG. 4A, an applicator 420, in accordance with some embodiments of the present disclosure, comprises a base plate 425 rotatably coupled with a top plate 430.

Figure 4B:
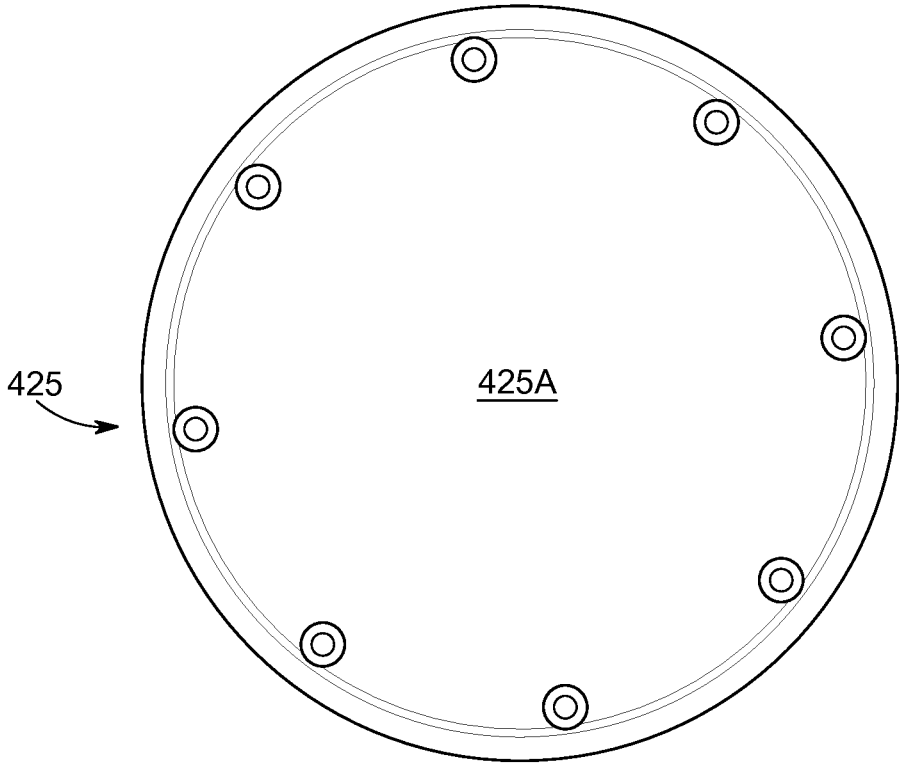

FIG. 4B illustrates an underside 425A of the bottom plate 425, in accordance with some embodiments of the present disclosure.

The underside 425A of the bottom plate 425 may be flat or comprise a plurality of protrusions, legs and/or the like so that the applicator 420 may be positioned and operated on a flat surface, such as a table or the like. In some embodiments, the applicator 420 is sized so that it can be held and operated in a user's hand.

Figure 4C:
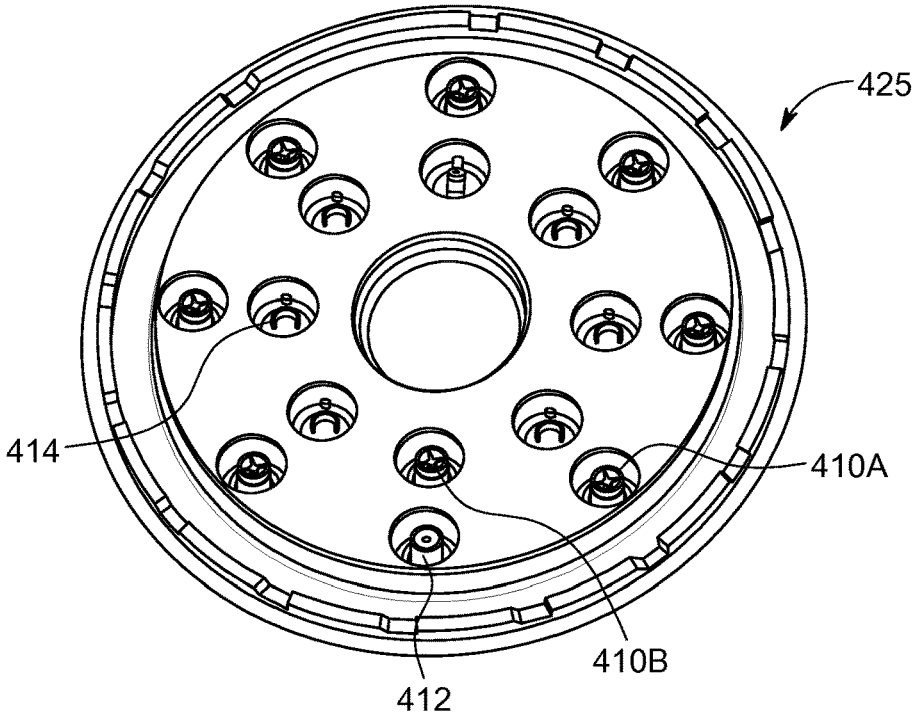

FIG. 4C illustrates a topside of the bottom plate 425. The top view of the bottom plate 425. In some embodiments, the bottom plate 425 comprises a plurality of insertion tips 412. The plurality of the insertion tips 412 are arranged circularly on the bottom plate 425.

In FIG. 4C, an unused cerumen protection plug 410A is depicted positioned on a one of the insertion tips 412. In embodiments of the present disclosure, the applicator 420 is provided to the user with each of the plurality of the insertion tips 412 coupled with a cerumen protection plug ready for insertion into a hearing device's sound conduit.

In some embodiments, the topside of the bottom plate 425 may comprise a removal tip 414. The removal tip 414 is configured to provide for coupling of the applicator 420 with a cerumen protection plug and removal of the cerumen protection plug from the sound conduit. In some embodiments, a plurality of the removal tips 414 are arranged circularly on the topside of the bottom plate 425.

In FIG. 4C, a used cerumen filter plug 410B is shown engaged with one of the removal tips 414. In embodiments where the topside of the bottom plate 425 comprises a plurality of the removal tips 414, each of the removal tips 414 may be used according to a single use protocol to provide for removing the cerumen filter plugs from the sound conduit and keeping each of the removed cerumen filter plug coupled with a one of the removal tips 414. In some embodiments, the topside of the bottom plate 425 may comprise a colour that contrasts with the cerumen filter plug to provide for ease of identification by a user as to whether one of the cerumen filter plugs is engaged/coupled with the insertion tip 412 and/or the engagement tip 414.

Figure 4D:
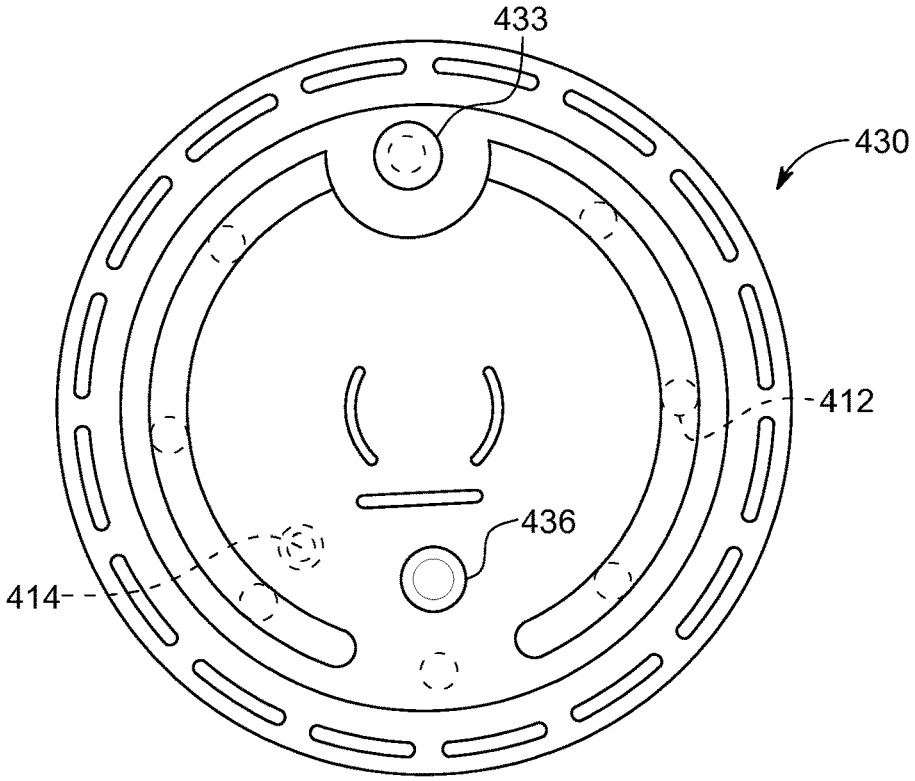

FIG. 4D shows a top plate for an applicator tool, in accordance with some embodiments of the present disclosure.

In embodiments of the present disclosure, a top plate 430 of the applicator is rotatably coupled with the bottom plate of FIGS. 4B and 4C. In some embodiments, the top plate 430 comprises an applicator opening 433. The applicator opening 433 is disposed at a radial location on the top plate 430, such that the top plate 430 can be rotated to provide for alignment of the applicator opening 433 with a one of the insertion tips 410A on the bottom plate. In this way, a user can rotate the top plate 430 until the applicator opening 433 is aligned with a one of the engagement tips 410A on the bottom plate that is coupled with an unused cerumen filter plug. Once the user has rotated the top plate 430 to align the applicator opening 433 with a one of the engagement tips 410A on the bottom plate that is couple with an unused cerumen filter plug, the user can insert the sound conduit of the hearing aid into the applicator opening 433 and onto insertion tip to install the cerumen filter plug into the sound conduit. The applicator may comprise a locking mechanism or the like to provide that the top plate 430 can only be rotated with respect to the bottom plate to a position where the applicator opening 433 is aligned with an insertion tip that is coupled with an unused cerumen filter plug.

In embodiments of the present disclosure, the applicator opening 433 is sized/shaped relative to the sound conduit to provide for guiding the sound conduit over the cerumen filter plug and/or the insertion tip. In some embodiments, the applicator opening 433 may comprise a funnel shape to provide for directing a sound conduit introduced into the applicator opening 433 over the cerumen filter plug and the insertion tip.

The top plate 430 may comprise a removal opening 436. In some embodiments, the removal opening 436 is disposed at a radial location on the top plate 430 such that the top plate 430 can be rotated to provide for alignment of the removal opening 436 with a one of the removal tips 414 on the bottom plate. In this way, a user can rotate the top plate 430 until the removal opening 436 is aligned with a one of the removal tips 414 on the bottom plate. Once the user has rotated the top plate 430 to align the removal opening 433 with a one of the removal tips 414 on the bottom plate, the user can insert the sound conduit of the hearing aid into the removal opening 436 and onto the removal tip 414 to provide for engaging/coupling the removal tip 414 with a cerumen filter plug in the sound conduit. After this engagement, which in some embodiments may be confirmed with an audible/tactile click, the cerumen filter plug may be coupled with the engagement tip and removed from the sound conduit.

In embodiments of the present disclosure, the removal opening 436 is sized/shaped relative to the sound conduit to provide for guiding the sound conduit over the engagement tip 414. In some embodiments, the removal opening 436 may comprise a funnel shape to provide for directing a sound conduit introduced into the removal opening 436 over the engagement tip 414.

In some embodiments, the applicator may comprise a locking mechanism or the like to provide that the top plate 430 can only be rotated with respect to the bottom plate to a position where the removal opening 436 is aligned with an engagement tip that is not coupled with a used cerumen filter plug. The applicator opening 433 and the removal opening 436 may be aligned on the top plate 430 such that rotation of the top plate 430 with respect to the bottom late provides for alignment of the applicator opening 433 with an insertion tip and alignment of the removal opening 436 with an engagement tip.

While the principles of the disclosure have been described above in connection with specific apparatuses and methods, it is to be clearly understood that this description is made only by way of example and not as limitation on the scope of the invention.

What is claimed is:

1. A cerumen filter applicator for replacing a cerumen filter in a sound conduit of a hearing device, the cerumen filter applicator comprising:

an insertion tip configured to fit inside the sound conduit of the hearing device, and comprising an insertion mechanism configured to engage with an engagement body of the cerumen filter to provide for inserting and/or positioning the cerumen filter in the sound conduit; and a removal tip configured to fit inside the sound conduit of the hearing device, and comprising a removal mechanism configured to adapt in size and couple with the engagement body of the cerumen filter to provide for removing the cerumen filter from the sound conduit, wherein:

the removal mechanism includes a removal cavity that extends centrally along a longitudinal axis of the removal tip; and the removal mechanism is configured to receive at least a portion of the engagement body within the removal cavity while the removal mechanism is coupled with the engagement body.

2. The cerumen filter applicator of claim 1, wherein the insertion mechanism comprises an insertion cavity.

3. The cerumen filter applicator of claim 2, wherein the insertion cavity comprises a shoulder section configured to butt against a section of the engagement body to provide for pushing the cerumen filter into the sound conduit.

4. The cerumen filter applicator of claim 2, wherein a section of the insertion cavity has an internal diameter that is less than or equal to an external diameter of a part of the engagement body such that in use the section of the insertion cavity holds the engagement body in the insertion cavity.

5. The cerumen filter applicator of claim 2, wherein the insertion cavity comprises a plurality of ridges disposed around an inner-surface of the insertion cavity and configured to produce a contact force to couple the insertion tip with the engagement body.

6. The cerumen filter applicator of claim 1, wherein the insertion tip is configured to position the cerumen filter along the sound conduit such that a portion of an inner-wall of the sound conduit extends between the cerumen filter and a sound opening of the sound conduit.

7. The cerumen filter applicator of claim 1, wherein the insertion tip comprises an outer diameter that is only slightly less than an internal diameter of the sound conduit to provide for guiding the insertion tip along the sound conduit.

8. The cerumen filter applicator of claim 1, wherein:

the removal cavity comprises a cavity wall and the cavity wall defines a cavity opening and an internal cavity volume;

at least a portion of the cavity wall comprises an elastic material and/or the cavity wall is elastically coupled with an applicator body such that the cavity opening comprises an elastic opening.

9. The cerumen filter applicator of claim 8, wherein the cavity opening is configured in use to clamp onto the engagement body.

10. The cerumen filter applicator according to claim 8, wherein the cavity opening is configured in use to elastically adapt to an outer-surface of the engagement body to provide for clamping a part of the engagement body within the internal cavity volume.

11. The cerumen filter applicator according to claim 8, wherein the cavity opening comprises a lip configured to clamp onto the engagement body.

12. The cerumen filter applicator according to claim 8, wherein the removal tip comprises a collar configured to slide over an outer-surface of the sound conduit.

13. The cerumen filter applicator of claim 12, wherein the collar provides for guiding the removal cavity centrally along the sound conduit to couple with the engagement body.

14. The cerumen filter applicator of claim 1, wherein the cerumen filter applicator comprises a stylus having a first end and a second end, and wherein the insertion tip is disposed at the first end and the removal tip is disposed at the second end.

15. The cerumen filter applicator according to claim 1, further comprising:

a base plate rotatably coupled with a top plate;

a plurality of the insertion tips coupled with and arranged in a circle around the base plate at a first distance from a center of the cerumen filter applicator;

a plurality of the removal tips coupled with and arranged in a circle around base plate at a second distance from the center of the cerumen filter applicator;

wherein:

the first and second distances are different; and the top plate comprises a first opening through the top plate at the first diameter distance and a second opening through the top plate at the second distance.

16. The cerumen filter applicator according to claim 15, wherein the first opening and the second opening are arranged on a same diameter of the top plate to provide for simultaneously aligning the first opening with one of the plurality of insertion tips and aligning the second opening with one of the plurality of removal tips.

17. The cerumen filter applicator according to claim 15, wherein one or more of the plurality of insertion tips are coupled with a new replaceable cerumen filter ready for insertion into the sound conduit.

18. The cerumen filter applicator according to claim 15, wherein the first opening is configured to guide the sound conduit over one of the insertion tips included in the plurality of insertion tips.

19. A method for removing a cerumen filter from a sound conduit of a hearing device using a cerumen filter applicator, comprising:

inserting a removal tip of the applicator into a sound opening of the sound conduit, the removal tip comprising a removal mechanism including a removal cavity that extends centrally along a longitudinal axis of the removal tip;

coupling the removal tip with an engagement part of the cerumen filter, wherein the engagement part of the filter extends centrally from the cerumen filter and at least partially within the removal cavity of the removal mechanism; and removing the removal tip coupled with the cerumen filter from the sound conduit.

20. The method of claim 19, wherein coupling the removal tip with the engagement part of the cerumen filter comprises pushing the removal tip along the sound conduit such that the removal cavity in the removal tip adjusts to accommodate at least part of the engagement part within the removal cavity.

* * * * *